US006693608B2

(12) United States Patent
Liu et al.

(10) Patent No.: US 6,693,608 B2
(45) Date of Patent: Feb. 17, 2004

(54) DRIVING CIRCUIT FOR A PLASMA DISPLAY PANEL AND METHOD THEREOF

(75) Inventors: Chen-Chang Liu, Kaohsiung Hsien (TW); Jih-Fon Huang, Chu-Pei (TW)

(73) Assignee: AU Optronics Corp., Hsin-Chu (TW)

( * ) Notice: Subject to any disclaimer, the term of this patent is extended or adjusted under 35 U.S.C. 154(b) by 302 days.

(21) Appl. No.: 09/819,749

(22) Filed: Mar. 29, 2001

(65) Prior Publication Data

US 2002/0003514 A1 Jan. 10, 2002

(30) Foreign Application Priority Data

Jul. 7, 2000 (TW) ..... 89113519 A

(51) Int. Cl.[7] ..... G09G 3/28; G09G 3/10
(52) U.S. Cl. ..... 345/60; 315/169.4
(58) Field of Search ..... 345/60, 204, 208, 345/211, 212, 214, 63, 67, 71; 315/169.4

(56) References Cited

U.S. PATENT DOCUMENTS 5,438,290 A * 8/1995 Tanaka ..... 315/169.4

6,480,189 B1 * 11/2002 Ide ..... 345/60

* cited by examiner

*Primary Examiner*—Chanh Nguyen
*Assistant Examiner*—Paul A. Bell
(74) *Attorney, Agent, or Firm*—Winston Hsu

(57) ABSTRACT

A driving method for a plasma display panel. The plasma display panel has a plurality of plasma display units. Each unit includes a first and second electrode forming a capacitor-like load, and a passivation layer formed above the first and second electrodes. The plasma display unit is filled with a dischargeable gas that generates wall charges above the passivation layer after application of a potential difference by a driving circuit. The driving circuit includes a resonant unit electrically connected to the first electrode of the plasma display unit. Firstly, the driving circuit charges the resonant unit. Next, the driving circuit resonates the capacitor-like load of the plasma display unit together with the resonant unit. By using the smooth slope of a sinusoidal waveform, abrupt discharge between the first and second electrodes can be avoided.

7 Claims, 5 Drawing Sheets

DRIVING CIRCUIT FOR A PLASMA DISPLAY PANEL AND METHOD THEREOF

BACKGROUND OF THE INVENTION

1. Field of the Invention

The present invention relates to a driving method for a plasma display unit of a plasma display, and more particularly, to a driving method that uses a resonant circuit to generate a sinusoidal waveform in a reset period to prevent violent discharge of the plasma display unit, to increase the image contrast of the display panel and to decrease the electric power consumption.

2. Description of the Prior Art

The plasma display panel has a large but thin size and does not produce radiation. Therefore, it is believed to be the trend of future large-sized displays. A plasma display panel contains a plurality of plasma display units disposed in a matrix form and filled with a dischargeable gas. A driving circuit follows a driving sequence to drive the plasma display units so as to excite and ionize the dischargeable gas to emit light through its discharge. The circuit characteristic of the plasma display panel is closely equivalent to a capacitor-like load. The driving method is to impose a high voltage and high frequency alternating current on both ends of the capacitor-like load so that the charges in the plasma display unit are driven back and forth. The ultraviolet light radiated during the driving procedure will be absorbed by the fluorescent agents applied on the display cells to emit visible light.

With reference to FIG. 1, a conventional plasma display panel 10 contains a back panel 12 installed in parallel to a transparent front panel 14. A plurality of electrode pairs 16 are installed beneath the front panel 14. Each electrode pair contains two electrodes 18, 19, with each electrode 18, 19 being long and rectangular in shape and having a fixed width. A dielectric layer 20 is formed beneath the front panel 14 and covering the electrode pair 16 to provide the capacitance needed for alternative driving so as to prevent electric breakdown. A passivation layer 22 is formed under the dielectric layer 20, and is usually composed of MgO to protect the dielectric layer 20 from deterioration due to plasma sputtering. The back panel 12 is formed with a plurality of ribs 24, and a plurality of data electrodes 26 between the ribs 24. Blue, red and green phosphors 30B, 30R, 30G are filled, respectively, between each two adjacent ribs 24. Dischargeable gas is filled between the front panel 14 and the rear panel 12 of the plasma display panel 10. The top of the plurality of ribs 24 is fixed under the passivation layer 22 to separate the plasma on both sides of the ribs 24 from communication and interference.

The electrodes 18, 19 of the plasma display 10 are also called the X and Y sustaining electrodes. The X and Y electrodes are wide and nearly-transparent conductors, usually made of indium tin oxide (ITO) to induce and maintain discharging. Beneath the X and Y sustaining electrodes 18, 19 are bus electrodes 36, 38, respectively. The bus electrodes 36, 38 are thin and opaque metal wires, usually made of Cr—Cu—Cr, to help the X and Y electrodes 18, 19 to induce discharging and to lower the resistance of the X and Y electrodes 18, 19.

As shown in FIG. 1, the intersection of each two ribs 24 and electrode pair 16 forms a subpixel unit 32B, 32R or 32G. The three subpixel units 32B, 32R, 32G constitute a pixel unit 34. The subpixel units 32B, 32R, 32G and the pixel unit 34 are represented by the areas enclosed by the dashed lines.

When a potential difference is applied on the X and Y sustaining electrodes 18, 19 in the subpixel units 32B, 32R, 32G and the data electrodes 26, the X and Y sustaining electrodes 18, 19 and the data electrodes 26 form an electric field to induce discharging of dischargeable gas to produce ultraviolet (UV) light, which is absorbed by the fluorescent agents 30B, 30R or 30G to emit visible light.

With reference to FIG. 2, the driving sequence of a conventional plasma display has the following periods: (a) reset period, (b) address period, (c) sustaining period, and (d) data erase period. In the reset period, the plasma display imposes a large potential difference on the X and Y sustaining electrodes of which the primary purpose is to generate the same amount of wall charges in each of the display units so that image data can be correctly recorded in the subsequent address period. The dischargeable gas in the plasma display unit can be excited and ionized in the sustaining period so as to discharge and result in image display.

In the plasma display panel disclosed in U.S. Pat. No. 6,037,916, a voltage waveform $P_{c1}$ is first imposed on the X and Y sustaining electrodes 18, 19 in the reset period of the driving sequence. However, such a voltage waveform is likely to cause instantaneous voltage changes in the plasma display unit. Therefore, some ions at higher energy levels will violently discharge, resulting in self-erase discharges and UV photons absorbed by the fluorescent agents on the display unit. As a result, the plasma display unit emits light of a certain intensity in the reset period when it should emit as little light as possible. Therefore, compared with the sustaining period for displaying images, the intensity contrast is less and cannot be increased.

In observation of the above problem, U.S. Pat. No. 5,745,086 discloses a slow rise and fall voltage waveform to generate wall charges in order to solve the side effect caused by instantaneous voltage waveform changes. A set of rise time control circuit and fall time control circuit produces the needed voltage waveform. The basic principle of the control circuit is to use a constant current source to charge resistor-like elements and the capacitor-like load of the plasma display panel. Then, a properly tuned RC time constant is provided to control the rising and falling speed of the voltage waveform. As well, due to the use of resistor-like elements, some electric power will be wasted on the resistor-like elements. Furthermore, since it uses a constant current power supply, the power source itself consumes energy. Therefore, this technique effectively increases the contrast, but is unable to control energy consumption.

SUMMARY OF THE INVENTION

Thus, it is a primary object of the invention to provide a new driving method for the plasma display unit which can effectively generate a sinusoidal waveform by using a resonant circuit so as to prevent the plasma display unit from misfiring, to increase the image contrast of the display panel, and to effectively reduce electrical power consumption.

According to the claimed invention, a driving method for a plasma display panel is used. The plasma display panel has a plurality of plasma display units. Each unit has first and second electrodes forming a capacitor-like load, and a passivation layer formed above the first and second electrodes. The plasma display unit is filled with a dischargeable gas that generates wall charges above the passivation layer after application of a potential difference by a driving circuit. The driving circuit comprises a resonant unit electrically connected to the first electrode of the plasma display unit. During a reset period, the driving circuit charges the resonant unit to produce an electrical potential difference between the two electrodes to form wall charges above the passivation layer. Next, the driving circuit resonates the capacitor-like load of the plasma display unit together with the resonant unit to produce a smooth sinusoidal waveform.

It is an advantage of the present invention that the driving method produces resonance between the resonant unit and the capacitor-like load so as to generate a sinusoidal waveform in the reset period. Since the smooth sinusoidal waveform does not have any abrupt edges, little self-erase dicharges will be generated, improving image contrast. As well, the use of resonance between the resonant unit and the capacitor-like load allows for a decrease in power consumption.

These and other objectives of the present invention will no doubt become obvious to those of ordinary skilled in the art after reading the following detailed description of the preferred embodiment, which is illustrated in the various figures and drawings.

DETAILED DESCRIPTION OF THE PREFERRED EMBODIMENT

Figure 1:
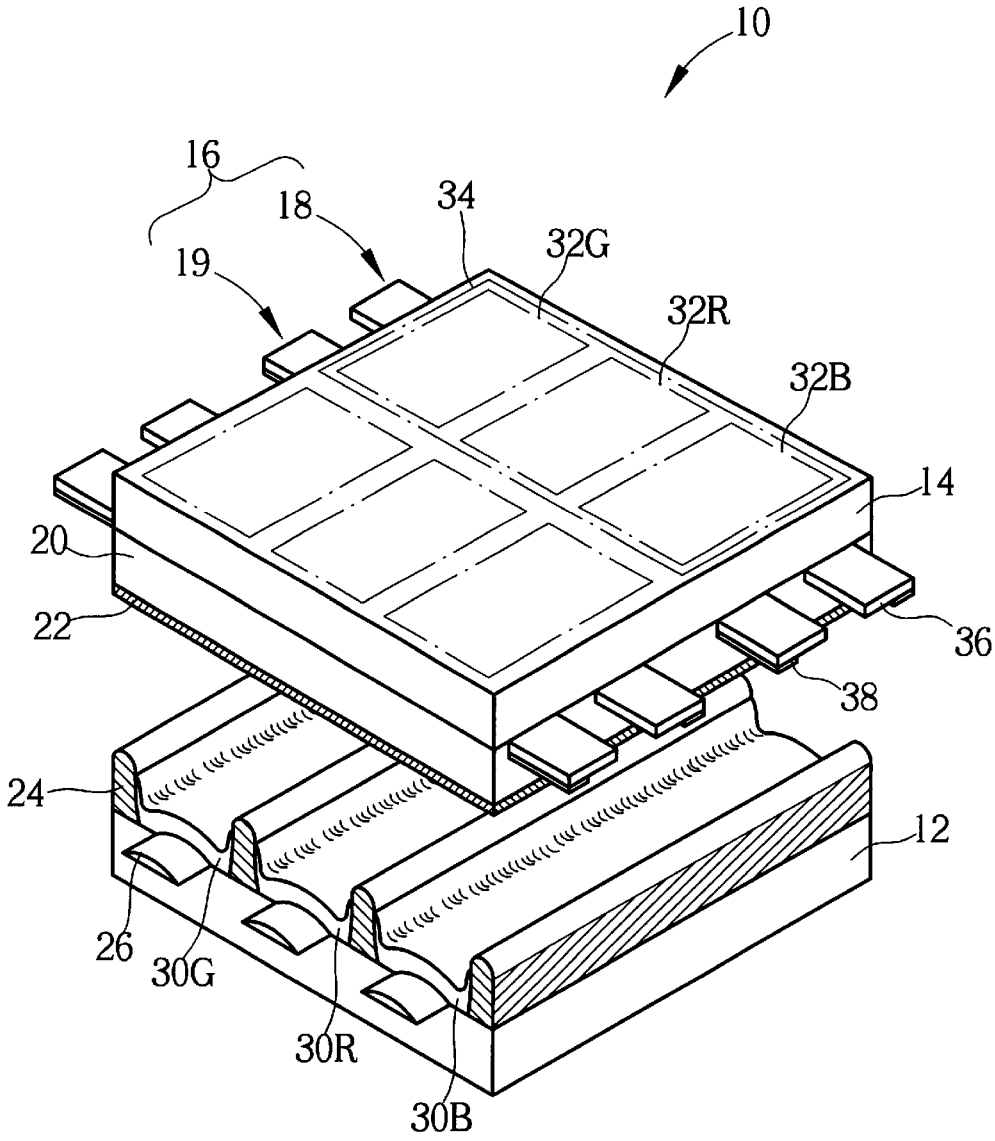
Fig. 1 Prior art
FIG. 1 is a schematic view of a conventional plasma display panel.
Figure 2:
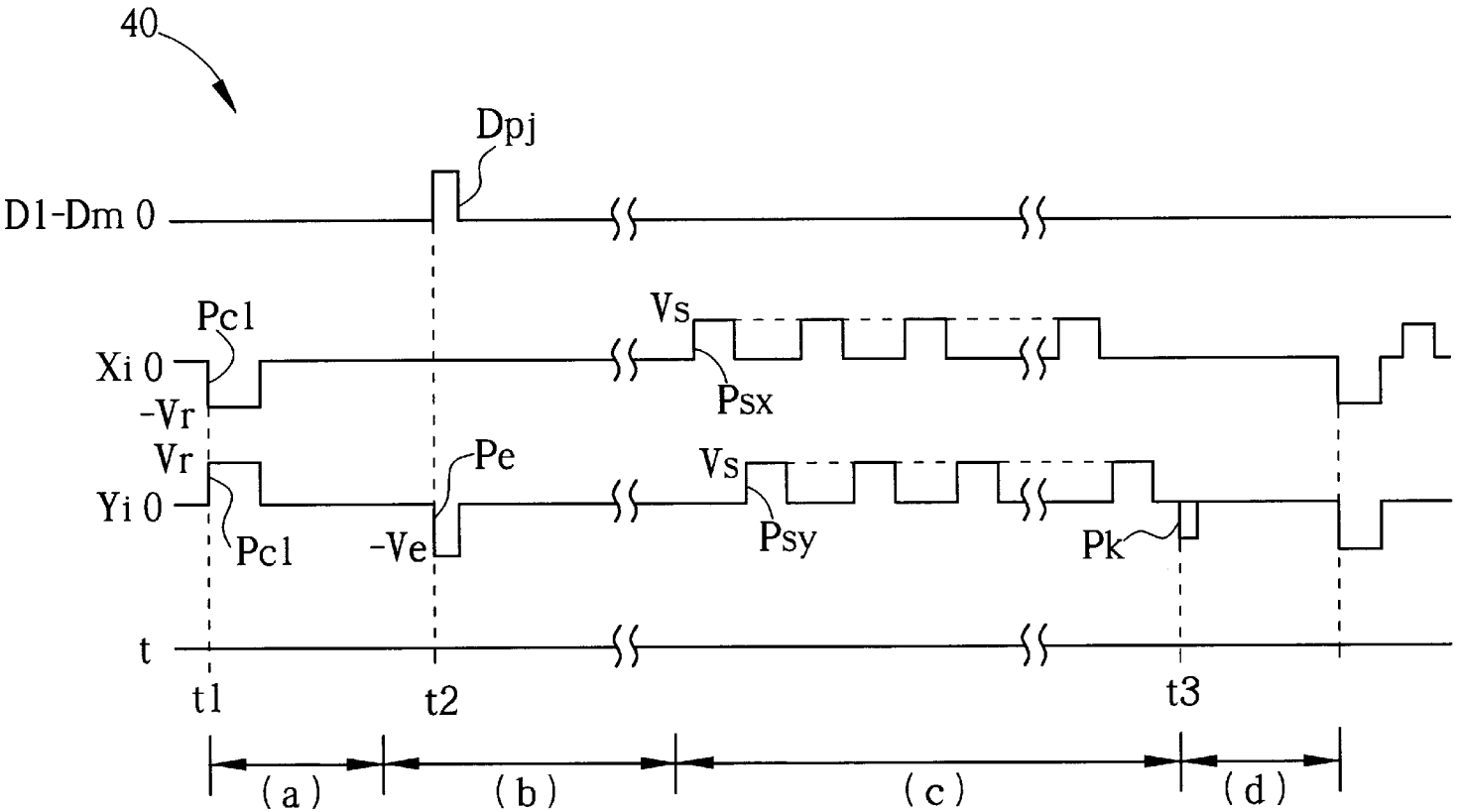
Fig. 2 Prior art
FIG. 2 is a time sequence diagram of the driving sequence of the plasma display panel in FIG. 1.
Figure 3:
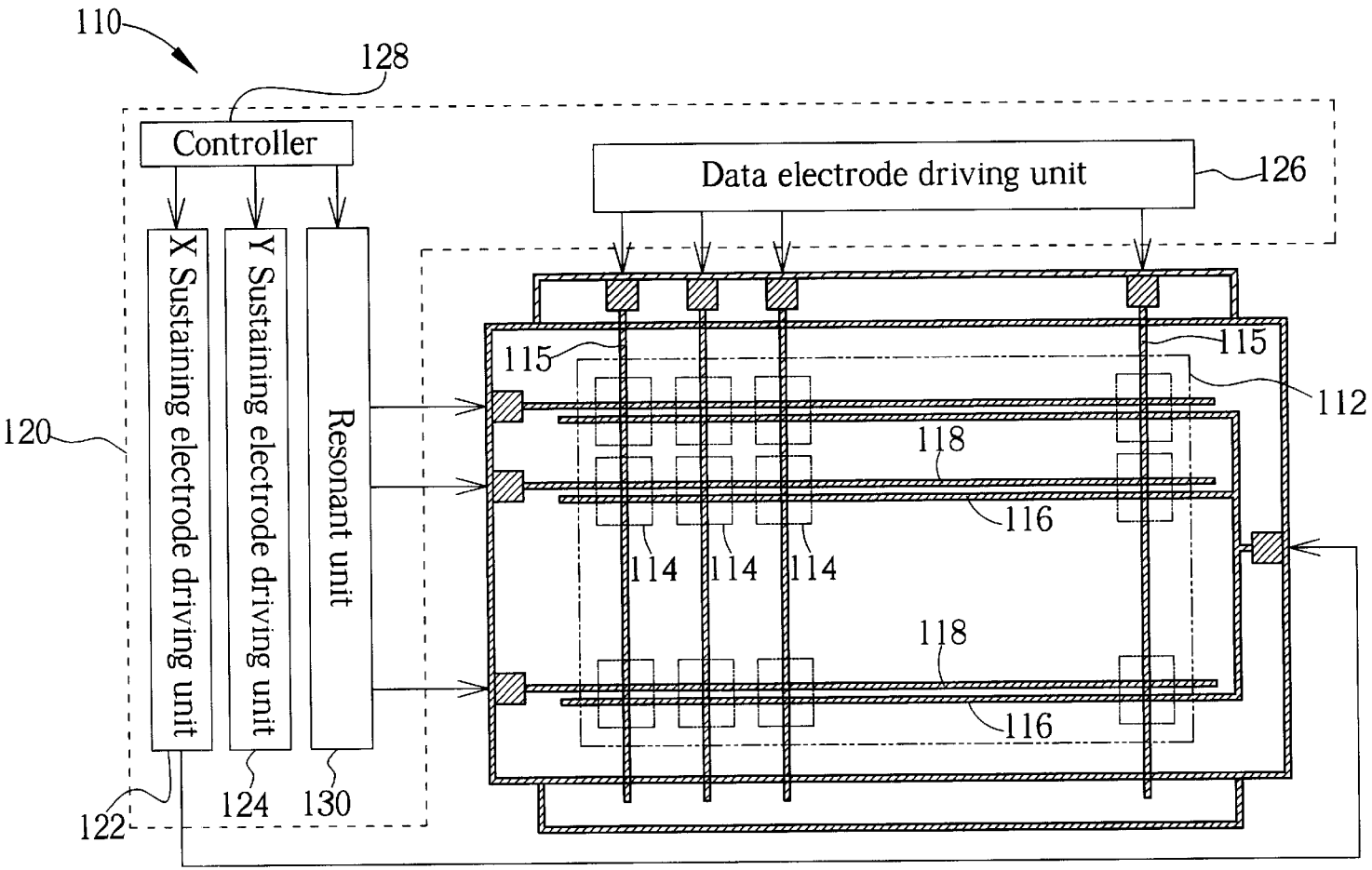
FIG. 3 is a block diagram of a plasma display panel according to the present invention.

With reference to FIG. 3, the plasma display panel 110 of the invention contains a glass substrate 112 for displaying images and a driving circuit 120 to drive and control the display images on the glass substrate 112. The plasma display panel 110 contains a plurality of plasma display units 114, each of which stores a dischargeable gas, a set of data electrodes 115, and two sets of sustaining electrodes 116, 118. The driving circuit 120 contains an X sustaining electrode driving unit 122, a Y sustaining electrode driving unit 124, a data electrode driving unit 126, a controller 128, and a resonant unit 130. The resonant unit 130 resonates with the plasma display units 114 in the reset period. The data electrode driving unit 126 writes data into each plasma display unit 114 in the address period so as to determine which plasma display unit 114 can emit light in the sustaining period. The X and Y sustaining electrode driving units 122, 124 which were used to drive the X and Y sustaining electrodes 116, 118, respectively, so that the dischargeable gas in the plasma display units 114 can be driven back and forth between the X and Y sustaining electrodes 116, 118, causing the plasma display units 114 to emit light. The controller 128 can control the X sustaining electrode driving unit 122, the Y sustaining electrode driving unit 124, the data electrode driving unit 126, and the resonant unit 130 in order to properly drive the plasma display units 114.

Figure 4:
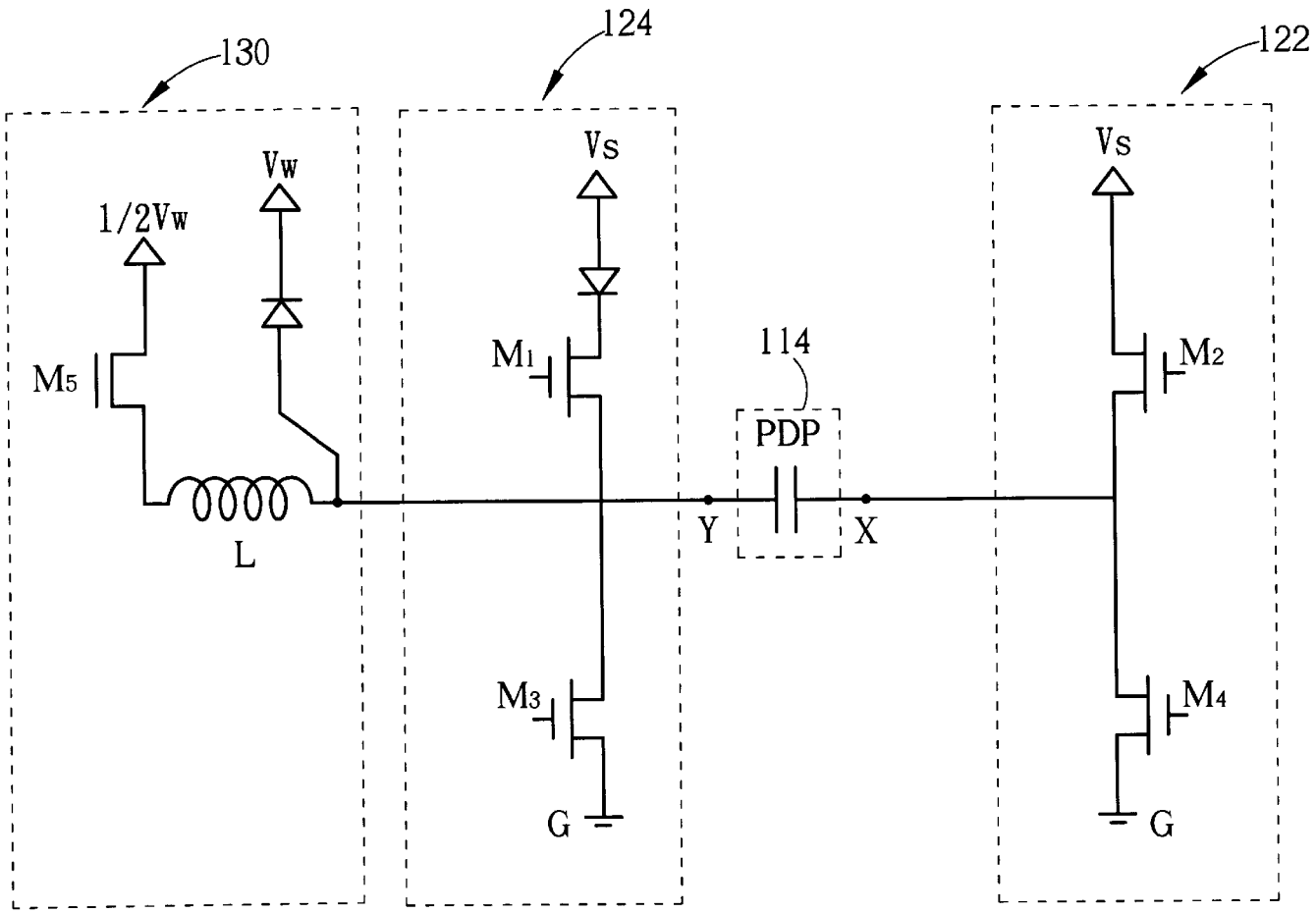
FIG. 4 is a circuit diagram of the driving circuit for the plasma display unit in FIG. 3.

With reference to FIG. 4, the plasma display unit 114 behaves similar to a capacitor-like load. The X and Y sustaining electrode driving units 122, 124 connect to both ends of the capacitor-like load for charging and discharging to maintain the display of an image signal. Therefore, the X and Y sustaining electrode driving units 122, 124 are symmetrical, whereby each is called a single-sided driving unit, and both together are called a double-sided driving unit. Furthermore, the driving circuit 120 contains a voltage source to provide an operating voltage Vs to the X and Y sustain driving units 122, 124 and a control circuit (not shown) to control the X and Y sustaining electrode driving units 122, 124. The voltage source Vs can charge and discharge the plasma display units 114 back and forth through the X and Y sustaining electrode driving units 122, 124 during the sustaining period.

The X sustaining electrode driving unit 122 includes a switch M2 electrically connected between the voltage source Vs and a node X of the plasma display unit 114, a switch M4 electrically connects between the node X and the ground G. The Y sustaining electrode driving unit 124 includes a switch M1 electrically connected between the voltage source Vs and a node Y of the plasma display unit 114, and a switch M3 electrically connects between the node Y and the ground G. The controller 128 allows the voltage source Vs to charge or discharge the plasma display unit 114 by manipulating the switches in the X and Y sustaining electrode driving units 122, 124. The resonant unit 130 contains a voltage source ½ Vw, a switch M5 and an inductant element L. Moreover, a diode connects between the voltage source Vw and the node X. Generally, the switches M1 through M5 are metal oxide semiconductor (MOS) transistors.

Figure 5:
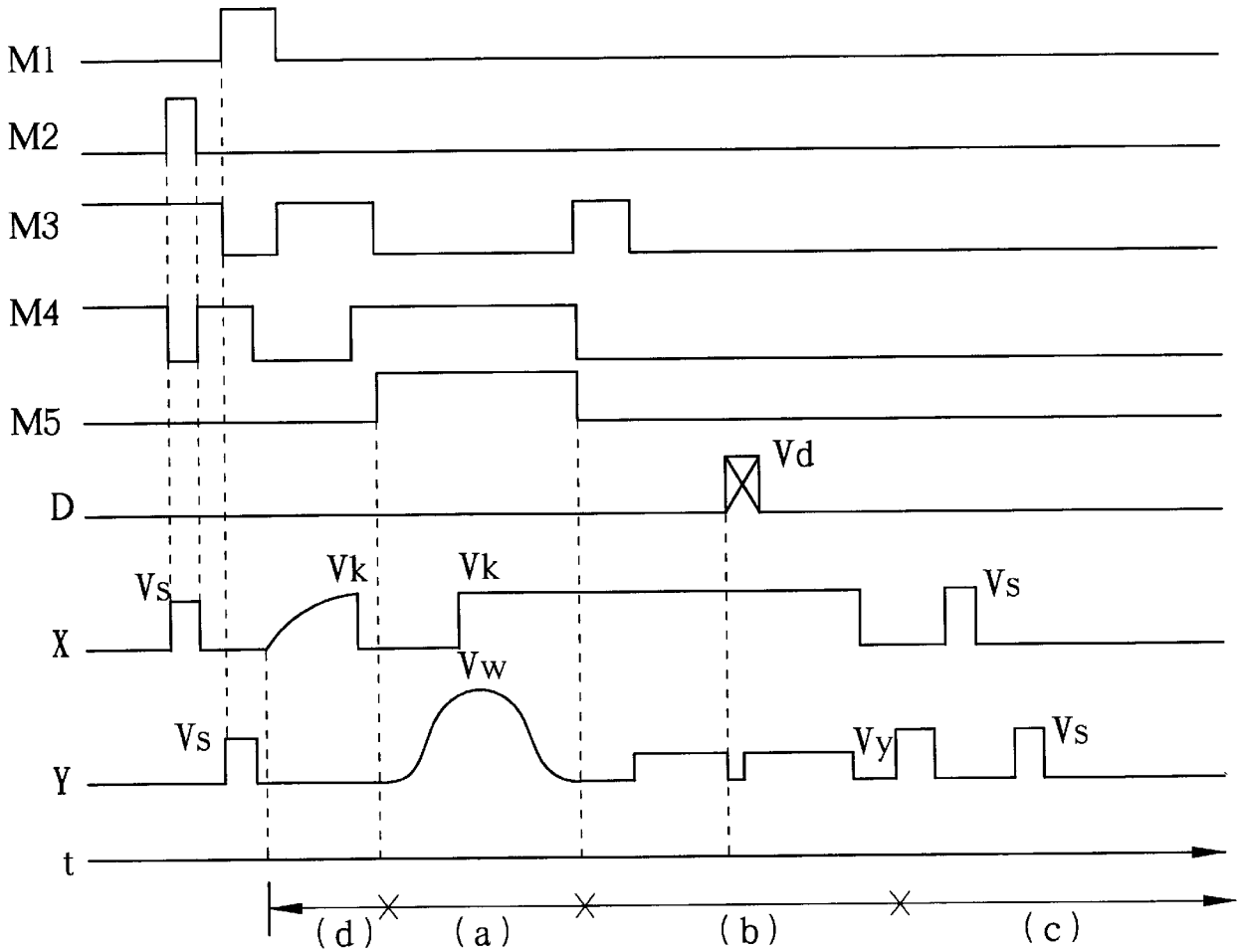
FIG. 5 is a time sequence diagram of the switches M1 through M5 and all the electrodes of the driving circuit in FIG. 4.

Referring to FIG. 5, the switches M1, M2, M3, and M4 are opened and closed by the regulation of the controller 128, so that the voltage source Vs can charge and discharge the plasma display unit 114 through the X and Y sustaining electrode driving units 122, 124. Detailed control sequences for the address and sustaining periods and the voltage waveform on the sustaining electrode X are similar to that of the prior art and are thus not repeated hereinafter. After imposing data erase waveforms in the data erase period, the positive wall charges of the plasma display unit 114 reacts with the negative wall charges, decreasing the amount of wall charges inside the plasma display unit 114, followed by the beginning of the reset period. The controller 128 first turns on the switch M5 so that the voltage source ½ Vw charges the inductant element L. The current in the inductant element L gradually increases from zero, causing the voltage on the node Y of the plasma display unit 114 to slowly increase. Since the inductant element L resonates with the capacitor-like load of the plasma display unit 114, the voltage on the node Y also gradually increases in a sinusoidal waveform. The maximum amplitude can reach twice the voltage source ½ Vw, i.e., Vw. When the node Y voltage reaches the maximum amplitude, the current on the inductant element L naturally and slowly decrease from the maximum amplitude, making the node Y voltage of the plasma display unit 114 slowly decrease in a sinusoidal waveform. When the current in the inductant element L returns to zero, the controller 128 shuts down the switch M5 and turns on the switch M3. The reset period is thus completed, followed by the address period.

By properly turning on and off the switch M5 in the reset period, the inductant element L will resonate with the capacitor-like load, generating a sinusoidal waveform at the node Y of the plasma display unit 114. Since the slope of the sinusoidal waveform varies slowly, the voltage of the plasma display unit 114 does not abruptly increase or decrease, preventing self-erase discharges that often occurs during the reset period of the prior art. By reducing the self-erase discharges that often occurs during the reset period, improper discharging and light emittance greatly decrease, allowing a more complete dark background. In contrast, the discharge illumination in the sustaining period becomes relatively brighter, increasing the image contrast of the plasma display panel 110. According to the disclosed driving method, the dark room contrast ratio can be as high as 600:1. In addition, because the on and off of the switch M5 are performed when the current in the inductant element L is zero, zero-current switching can be achieved. In other words, the on and off of the switch M5 does not result in any energy consumption and thus lowers the power consumption of the plasma display panel 110.

Compared with the prior art, the advantage of the plasma display unit 114 is that its driving circuit contains a resonant unit which has an inductant element L resonating with the capacitor-like load of the plasma display unit 114. Due to the resonance between the inductant element L and the capacitor-like load, the plasma display unit 114 presents a sinusoidal waveform voltage in the reset period. Using the smooth slope of the sinusoidal waveform, the plasma display unit 114 does not have abrupt increases or drops in the reset period. Therefore, the discharge intensity of the disclosed plasma display unit 114 in the reset period is small. That is, a weak emittance of light occurs from the plasma display unit 114 in the reset period to provide a good dark background contrast for subsequent discharge illumination. If the glass substrate 112 of the plasma display panel 110 provides a more complete dark background in the reset period, the discharge illumination in the sustaining period will appear relatively brighter to the user, and thus increasing the image contrast of the plasma display panel 110.

Another advantage of the invention is that the energy consumption of the plasma display unit 114 is decreased in the reset period. Since the sinusoidal waveform needed for generating wall charges on the plasma display unit 114 is formed by the resonance between the inductant element L and the capacitor-like load, the energy is only transferred between the inductant element and the capacitor-like load. Furthermore, the on and off of the switch M5 of the present invention is achieved at zero current, and thus there is no energy loss. In comparison, the rising or falling voltage waveform needed for generating wall charges in U.S. Pat. No. 5,745,086 is achieved by the combination of a constant current source and a capacitor-like load of the plasma display panel, wherein the constant current source causes energy loss. Also, the rising or falling voltage waveform needed for generating wall charges in U.S. Pat. No. 6,037,916 is achieved by the combination of a resistor element and a capacitor-like load of the plasma display panel, wherein the resistor element causes energy loss. However, the energy loss in the reset period of the present invention is minimized.

In the present invention, the operating voltage needed in the address period of the plasma display unit 114 is also decreased. Normally, the plasma display unit 114 in the reset period accumulates a certain number of wall charges before forming the corresponding voltage. This voltage value has to be maintained to prevent abnormal discharges in the sustaining period. The voltage needed for the subsequent address period has to be greater since the imposed voltage waveform Pc1 in the prior art can cause instantaneous voltage change in the plasma display unit, resulting in violent discharges or self-erasure among wall charges due to an abrupt voltage drop. The voltage difference between the Y sustaining electrode and the data electrode has to achieve around 220V in order to ensure correct data recording so that the plasma display unit 114 can correctly discharge and emit light in the sustaining period.

According to the disclosed plasma display unit 114, the characteristic curve of the imposed electrical potential difference in the reset period is a sinusoidal waveform, therefore the plasma display unit 114 does not produce violent discharges. By adjusting the sinusoidal waveform, the voltage formed by the accumulated wall charge can be regulated to be near yet lower than the voltage needed for discharges between the Y sustaining electrode and the data electrode. Thus, there is no destruction of wall charges or self-erasure due to abrupt voltage drop as in the prior art. The operating voltage for the plasma display unit 114 in the address period can be smaller. The voltage between the Y sustaining electrode and the data electrode only needs to be around 130V for correct data writing. The driving voltage for the data electrode driving unit 126 and the relevant IC can be lower so that the power consumption of the plasma display panel 110 is smaller.

Those skilled in the art will readily observe that numerous modifications and alterations of the device may be made while retaining the teachings of the invention. Accordingly, the above disclosure should be construed as limited only by the metes and bounds of the appended claims.

What is claimed is:

1. A driving method for a plasma display panel, the plasma display panel having a plurality of plasma display units and a driving circuit, each of the plasma display units including a first electrode and a second electrode for forming a capacitive load, and a passivation layer formed above the first and second electrodes, the plasma display unit filled with a dischargeable gas, the driving circuit including a resonant unit electrically connected to the first electrode of the plasma display unit, the driving method comprising:

charging the resonant unit in a reset period to change the voltage level of the first electrode for generating a first potential difference between the first and the second electrodes of the plasma display unit, so as to create wall charges above the passivation layer; and resonating the capacitive load of the plasma display unit in the reset period using the resonant unit to generate a sinusoidal waveform for resetting the display units so as avoid abrupt discharge between the first and second electrodes.

2. The driving method of claim 1, wherein the plasma display panel further comprises a controller electrically connected to the driving circuit to control the plasma display panel, and the resonant unit comprises a constant voltage source, a switch and an inductant element; wherein the controller charges and discharges the inductant element with the constant voltage source by turning on or off of the switch.

3. The driving method of claim 2, wherein the controller first turns on the switch to charge the inductant element with the constant voltage source from a zero current state so as to resonate the inductant element with the capacitive load of the plasma display panel, and the switch is turned off when the resonated sinusoidal waveform reduces to the zero current state.

4. The driving method of claim 1, wherein the driving circuit further comprises two driving units respectively electrically connected to the first and the second electrodes of the plasma display unit for driving the dischargeable gas between the two electrodes back and forth.

5. A driving circuit for driving a plasma display panel, the plasma display panel having a plurality of plasma display units, each of the plasma display units having a first electrode and a second electrode forming a capacitive load, and a passivation layer formed above the first and second electrodes, the plasma display panel filled with a dischargeable gas for generating wall charges, the driving circuit comprising:

two driving units for driving the dischargeable gas between the first and the second electrodes, the driving units respectively electrically connected to the first and the second electrodes of the plasma display units;

a resonant unit electrically connected to the first electrode of the plasma display unit, the driving circuit charging the resonant unit to build an electrical potential difference between the first and the second electrodes so as to generate wall charges above the passivation layer;

wherein the resonant unit resonate with the capacitive load of the plasma display unit to generate a sinusoidal waveform for resetting the display units in a reset period so as to avoid abrupt discharging between the first and second electrodes.

6. The driving circuit of claim 5, wherein the plasma display panel further comprises a controller electrically connected to the driving circuit for controlling the plasma display panel, and the resonant unit comprises a constant voltage source, a switch and an inductant element, the controller charging and discharging the inductant element with the constant voltage source by turning on and turning off the switch respectively.

7. The driving circuit of claim 6, wherein the controller first turns on the switch to charge the inductant element with the constant voltage source from a zero current state, and resonates the inductant element with the capacitive load of the plasma display unit. the switch being turned off when the resonant sinusoidal waveform reduces to the zero current state.

* * * * *